United States Patent [19]

Matsuda et al.

[11] 4,417,517

[45] Nov. 29, 1983

[54] PRINTER WITH MOVEABLE PAPER STRIP GUIDE ROLLS

[75] Inventors: Susumu Matsuda; Nobuaki Matsukura, both of Shizuoka; Masataka Suzuki, Oohito; Tsugio Narushima, Mishima, all of Japan

[73] Assignee: Tokyo Electric Co., Ltd., Tokyo, Japan

[21] Appl. No.: 386,800

[22] Filed: Jun. 9, 1982

[30] Foreign Application Priority Data

| | | | |
|---|---|---|---|
| Jun. 19, 1981 | [JP] | Japan | 56-94611 |
| Jun. 19, 1981 | [JP] | Japan | 56-90785 |
| Jun. 19, 1981 | [JP] | Japan | 56-90787 |

[51] Int. Cl.[3] ..... B41F 1/08; B41J 11/50

[52] U.S. Cl. ..... 101/288; 400/584; 400/605; 400/43; 101/66

[58] Field of Search ..... 101/288, 66, 67, 90; 400/578, 584, 585, 585.1, 586, 588, 592, 593, 600.2, 600.3, 605, 608.1, 608.2, 611, 617, 621, 43

[56] References Cited

U.S. PATENT DOCUMENTS

| | | | |
|---|---|---|---|
| 3,774,530 | 11/1973 | Woodie et al. | 101/66 |
| 4,011,811 | 3/1977 | Kodis | 400/584 |
| 4,027,765 | 6/1977 | Crump | 400/43 |
| 4,094,244 | 6/1978 | Edwards | 101/288 X |
| 4,188,138 | 2/1980 | Yamazaki | 400/586 |
| 4,293,236 | 10/1981 | Shimizu | 400/593 |
| 4,348,125 | 9/1982 | Fujiwara et al. | 400/605 X |
| 4,382,704 | 5/1983 | Hendrischk | 400/585 |

FOREIGN PATENT DOCUMENTS

| | | | |
|---|---|---|---|
| 2855253 | 7/1980 | Fed. Rep. of Germany | 400/605 |
| 2912656 | 10/1980 | Fed. Rep. of Germany | 400/605 |
| 2304476 | 10/1976 | France | 400/584 |
| 557067 | 12/1974 | Switzerland | 400/584 |

OTHER PUBLICATIONS

"Cut Form & Journal Printer", IBM Technical Disclosure Journal, vol. 20, No. 9, Feb. 1978, pp. 3622–3623.

*Primary Examiner*—E. H. Eickholt

*Attorney, Agent, or Firm*—Frishauf, Holtz, Goodman & Woodward

[57] ABSTRACT

An apparatus with a printer for a printing paper strip includes a paper feed guide having an outlet on one side of a platen, a paper discharge guide having an inlet on the other side of the platen, a unit frame attached to an apparatus housing to be able to rock between an open position where the paper discharge guide is exposed and a closed position where the paper discharge guide is covered and the printing paper strip is allowed to be guided, a drive roller provided to the apparatus housing located on the other side of the platen, a pinch roller mechanism provided to the unit frame and having a pinch roller which goes away from the drive roller when the unit frame is located in the open position, and approaches the driver roller when the unit frame is located in the closed position, and a rotation drive mechanism for rotating the drive roller to carry the printing paper strip from the paper feed guide to the paper discharge guide via the platen.

9 Claims, 10 Drawing Figures

FIG. 9
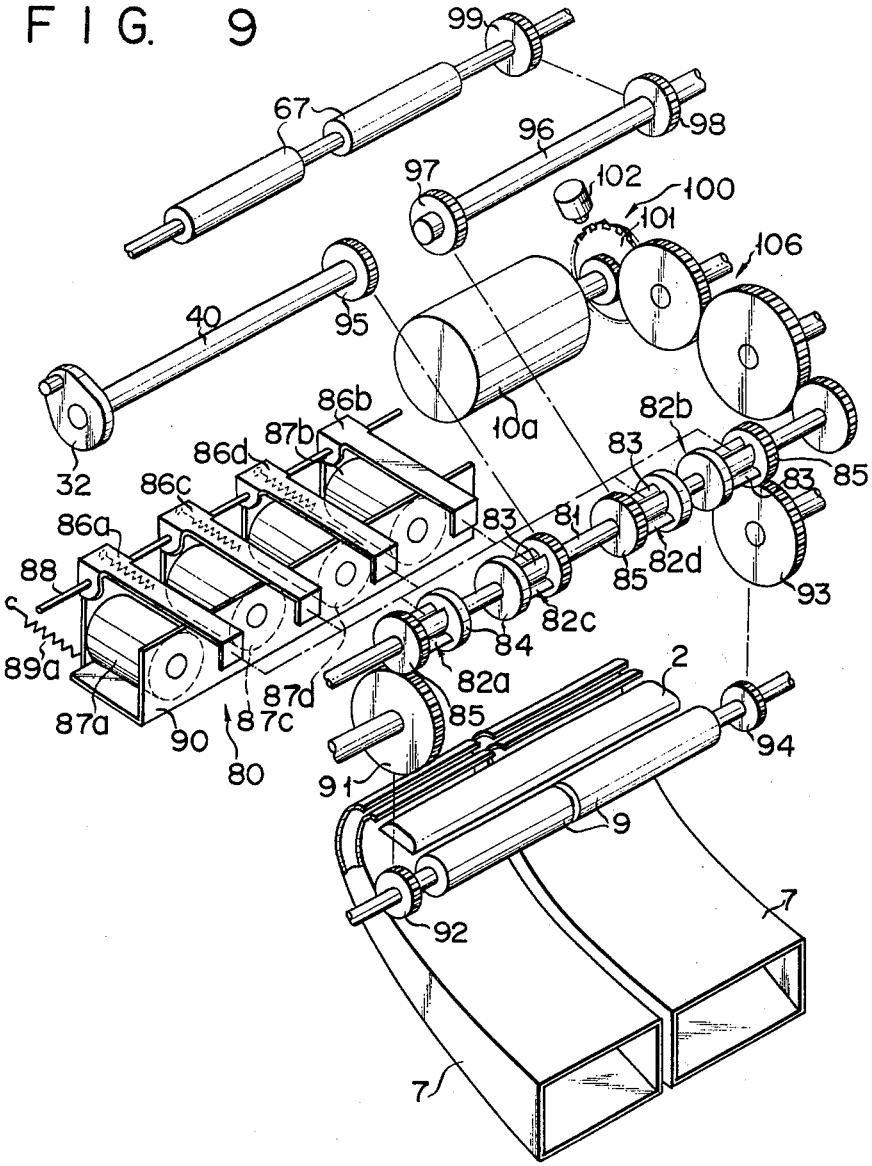
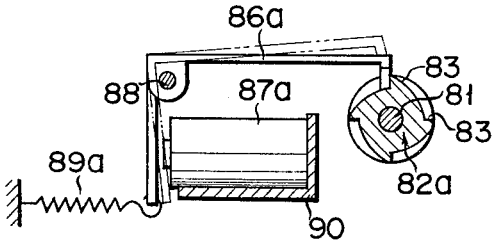
FIG. 10

PRINTER WITH MOVEABLE PAPER STRIP GUIDE ROLLS

BACKGROUND OF THE INVENTION

This invention relates to an apparatus with a printer, such as an electronic cash register, accounting machine, etc., which is provided with a paper feed mechanism for feeding printing paper strips.

Conventionally, machines or apparatus of this type, such as electronic cash registers, are provided with a pinch roller mechanism for urging a printing paper strip or blank strip to move along a guide for guiding the same, a stamp mechanism for stamp-printing the blank strip, and a cutter mechanism for cutting the blank strip. These mechanisms are formed independently of one another, and are separately fixed to the apparatus housing in a built-in manner. Therefore, maintenance work for the mechanisms is troublesome, and setting work for the blank strip is complicated because the blank strip need be passed through all those individual mechanisms. In feeding the blank strip, moreover, resistance will be produced at various portions of the apparatus. Particularly, in the prior art apparatus, resistance produced on the feeding end side of a platen will break the close contact between the blank strip and the platen, so that print quality will be lowered, printing noise will be increased, and printing paper will be caught by a printing head to cause jam.

SUMMARY OF THE INVENTION

The object of this invention is to provide an apparatus with a printer capable of facilitating maintenance and setting work for printing paper strips, as well as of improvement of print quality, reduction of printing noise, and preventing jam at the printing section.

BRIEF DESCRIPTION OF THE DRAWINGS

FIGS. 4 and 5 show a fixed blade mechanism of a cutter mechanism, in which FIG. 4 is a sectional view, and FIG. 5 is a disassembled perspective view;

FIG. 9 is a disassembled perspective view showing a clutch mechanism; and

FIG. 10 is a sectional view showing part of the clutch mechanism.

DETAILED DESCRIPTION OF THE PREFERRED EMBODIMENT

There will now be described an apparatus with a printer according to one embodiment of this invention with reference to the accompanying drawings.

Figure 1:
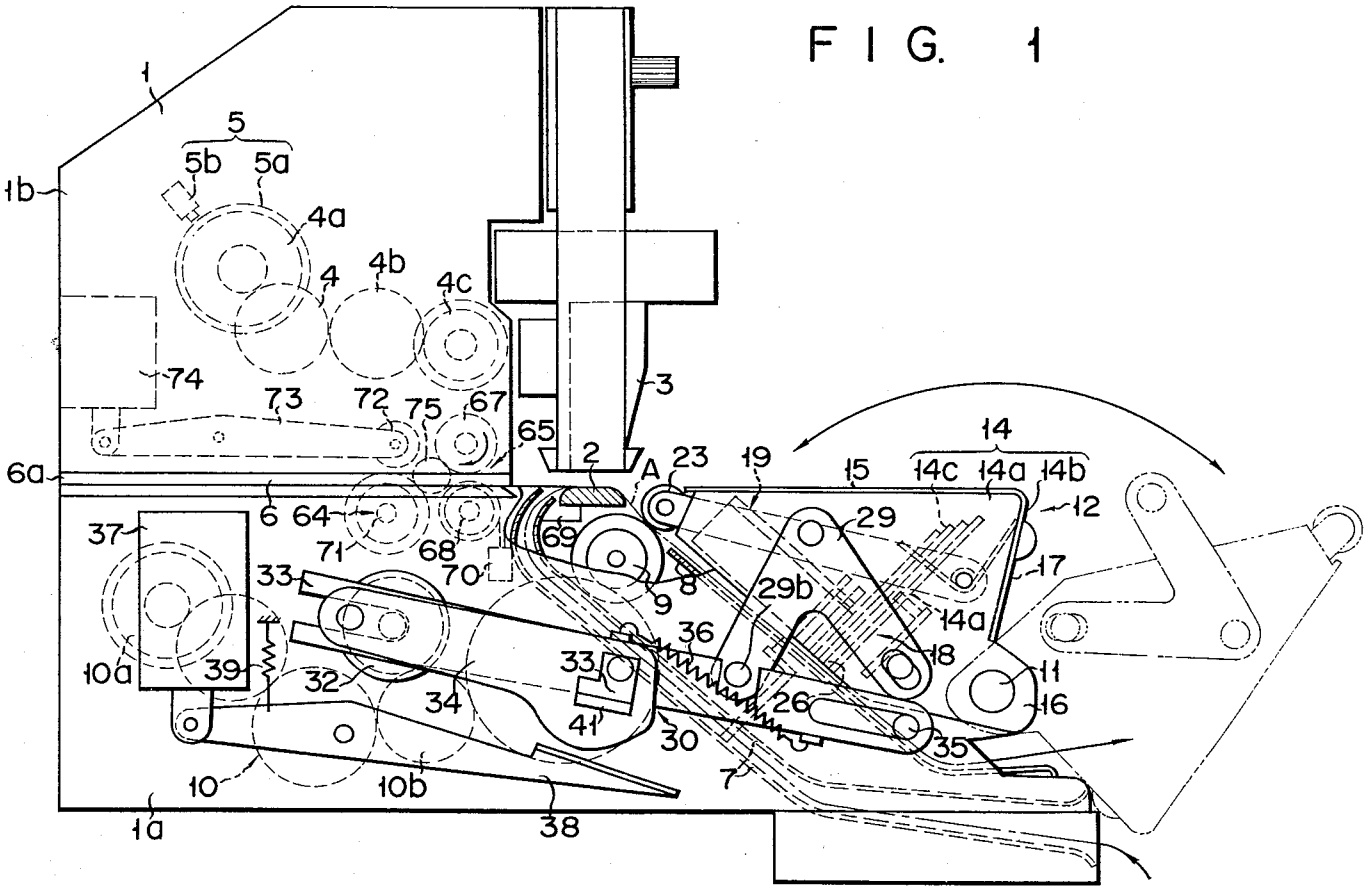
FIG. 1 is a general side view, partially in section, schematically showing an apparatus with a printer according to an embodiment of this invention.

In FIG. 1, numeral 1 designates an apparatus housing which is composed of a base section 1*a* with a substantially flat upper surface and a support section 1*b* standing on the rear portion of the base section 1*a*. Attached to the upper middle portion of the base section 1*a* is a platen 2 which extends along the width of the base section 1*a*. Over the platen 2 lies a printing head 3 of a dot-printing system so as to face the platen 2. The printing head 3 is supported on the front of the support section 1*b* so as to be able to move along the longitudinal direction of the platen 2. The support section 1*b* is provided with a head drive mechanism 4 which includes a motor 4*a*, a gear train 4*b*, and a drive cam 4*c*. The rotation force of the motor 4*a* is transmitted through the gear train 4*b* to the drive cam 4*c*, whereby the printing head 3 is caused to reciprocate along the longitudinal direction of the platen 2. The support section 1*b* is further provided with a rotation detector 5. The rotation detector 5 is composed of a detecting disk 5*a* coaxially attached to the rotating shaft of the motor 4, and a sensor 5*b* formed of a proximity switch for detecting the rotation angle of the detecting disk 5*a*. The printing timing of the printing head 3 is set by output pulses from the rotation detector 5.

Disposed on the upper surface of the rear portion of the base section 1*a* is a slip blank guide 6 with its front end located near the region behind the platen 2. The guide 6 is intended to guide a slip blank (not shown) substantially horizontally to deliver it to the platen 2. The rear end of the guide 6 is opened at a region 6*a* on the back of the housing 1. The opening 6*a* allows the slip blank to extend beyond the back of the housing 1 if the blank is relatively long and can bear, for example, 50 lines.

Arranged parallel in the base section 1*a* are a receipt blank feed guide 7 for feeding a receipt blank strip to the platen 2, and a journal blank feed guide (not shown) for feeding a journal blank strip (not shown) to the platen 2. Since these two feed guides are of substantially the same construction, the construction and operation of only the receipt blank feed guide 7 as a representative will be described below. The guide 7 is composed of a pair of plate members spaced vertically, and is disposed obliquely so that its lower end is opened on the front side of the housing 1 and its upper end at the back of the platen 2. Thus, a blank strip A may be guided upward and led to the platen 2 from behind. A discharge guide 8 is set in the base section 1*a* so as to face the feed guide 7 in front of the platen 2. The discharge guide 8 is used for both receipt and journal blank strips, and guides these blank strips downward. The lower end portion or terminal portion of the discharge guide 8 is located below the terminal portion of the slip blank guide 6.

Inside the base section 1*a*, a pair of feed rollers 9 are disposed between the platen 2 and the starting portion of the discharge guide 8. The rollers 9 are arranged parallel to each other so as to correspond to the receipt and journal blank strips, respectively. The rollers 9 are rotated independently of each other by a drive mechanism 10 mentioned later.

Figure 6:
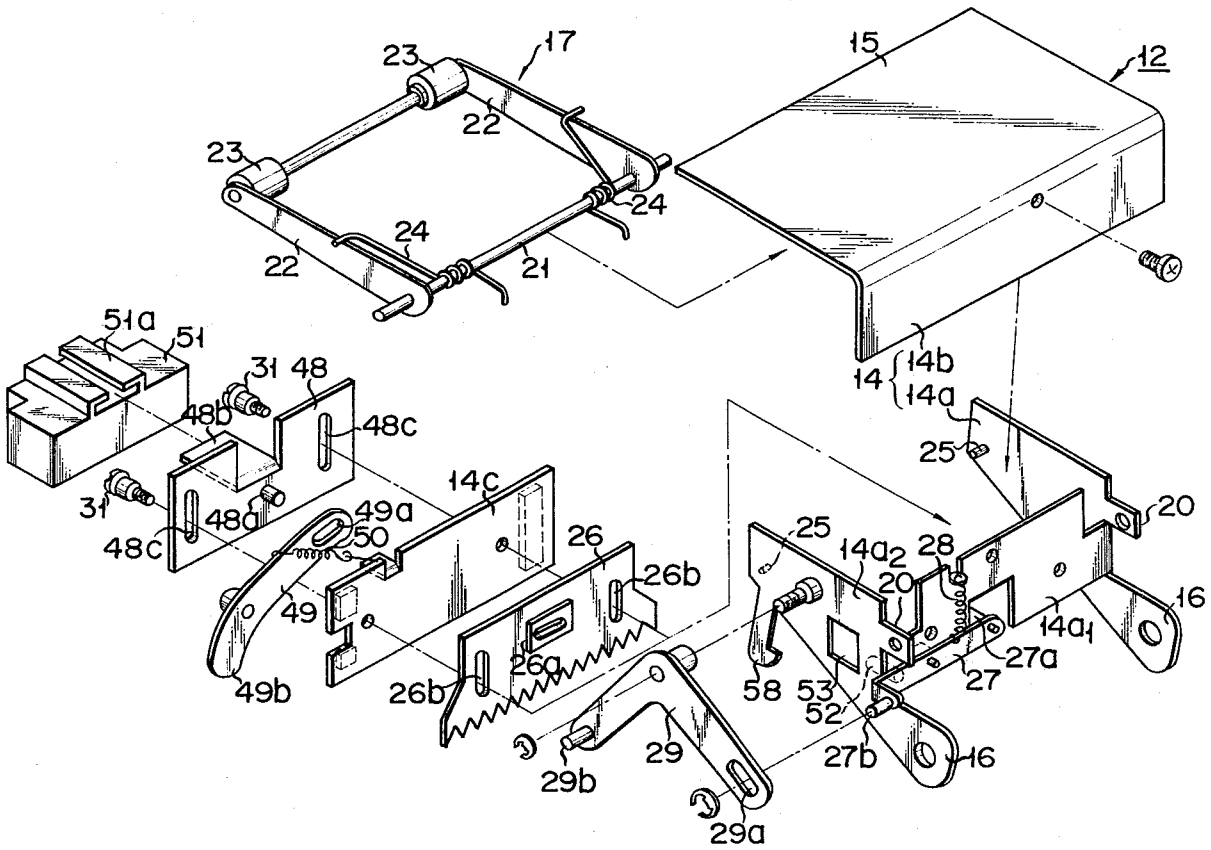
FIG. 6 is a disassembled perspective view of the swing unit.

A pair of swing units 12 are arranged parallel to each other at the base section 1*a*. Each swing unit 12 includes a unit frame 14 which is pivotally mounted on a shaft 11 lying on the front side of the lower portion of the base section 1*a* so that the unit frame 14 can swing relatively to the base section 1*a*. One unit frame is provided for the receipt blank strip A, while the other is provided for the journal blank strip. As shown in FIG. 6, the unit frame 14 for the receipt blank strip A comprises a substantially U-shaped frame body 14*a* and a substantially horizontal plate-like frame cover 14*b* with one end bent downward. The frame cover 14*b* is removably attached to the frame body 14*a* so as to cover the top thereof. The frame body 14*a* has a mounting portion 16 at each end, and the shaft 11 is inserted in holes formed severally in the mounting portions 16. Thus, the unit frame 14 is allowed to swing between a closed position in which the discharge guide 8 is covered as shown in FIG. 1 and an open position in which the discharge guide 8 is exposed to the outside. The frame cover 14*b* is so designed that its flat outer surface forming a guide wall 15 is substantially flush with the slip blank guide 6 when the frame 14 is in the closed position.

Each swing unit 12 further includes a pinch roller mechanism 17 attached to the unit frame 14, a movable blade mechanism 18, and a driven mechanism 19 of a stamp mechanism. As shown in FIG. 6, the pinch roller mechanism 17 has a shaft 21 which is inserted at both ends in holes of shaft support portions 20 protruding severally from both ends of the frame body 14*a* so that the shaft 21 is sustained horizontally. The respective proximal end portions of a pair of arms 22 are pivotally mounted on both end portions of the shaft 21. The arms 22 isolatedly extend parallel to each other under the frame cover 14*b* to reach the platen side of the cover 14*b*. Rotatably attached to the extended ends of the arms 22 are both ends of a shaft which is provided with a pair of coaxial rollers 23. The shaft 21 is wound with the middle portions of two coil springs 24. Both ends of each spring 24 engage the arm 22 corresponding thereto and the frame body 14*a*, respectively. By the agency of the springs 24, the rollers 23 are brought into rotatably contact with the feed rollers 9 with the aid of the arms 22 when the swing unit 12 is located in the closed position. In order to regulate the downward spring-urged rocking of the arms 22, there are provided stoppers 25 which protrude from the inside of the frame body 14*a* so as to be able to engage the lower ends of the arms 22.

The movable blade mechanism 18, which constitutes part of a cutter mechanism, includes a movable blade 26, a movable blade arm 27, a spring 28, and a bell crank 29, as shown in FIG. 6. The movable blade mechanism 18 is separated from a drive mechanism 30 (shown in detail in FIG. 7) of the cutter mechanism, and can be linked to the drive mechanism 30 when the swing unit 12 is in the closed position. The movable blade 26 is slidably interposed between an intermediate plate portion 14$a_1$ of the frame body 14*a* and an auxiliary frame 14*c* which is fixed parallel to the intermediate plate portion 14$a_1$ by means of screws 31. The movable blade 26 has a serrated edge at the lower end thereof, a horizontally extending slot 26*a* in the center, and vertically extending slots near both ends. The movable blade arm 27 is pivotally supported at the middle portion thereof on one end portion of the intermediate plate portion 14$a_1$, having its both ends extending substantially horizontally. An engaging pin 27*a* protrudes from one end of the arm 27, and is loosely fitted in the horizontal slot 26*a* of the movable blade 26, penetrating an indentation formed in the intermediate plate portion 14$a_1$. Thus, the movable blade 26 is supported on the arm 27 by means of the pin 27*a*. A tension spring 28 is connected between one end of the arm 27 and a raised strip of the intermediate plate portion 14$a_1$ located over the one end. By the tension spring 28, the arm 27 is urged to rock in the counterclockwise direction of FIG. 6, so that the movable blade 26 is urged upward. The bell crank 29 is pivotally mounted at the middle portion thereof on one side wall 14$a_2$ of the frame body 14*a*. Formed at one end portion of the crank 29 is a slot 29*a*, in which is loosely fitted an engaging pin 27*b* protruding from the other end portion of the movable blade arm 27. The other end portion of the crank 29 is fitted with an interlocking receiving portion 29*b* formed of a projection, as described in detail later.

Figure 7:
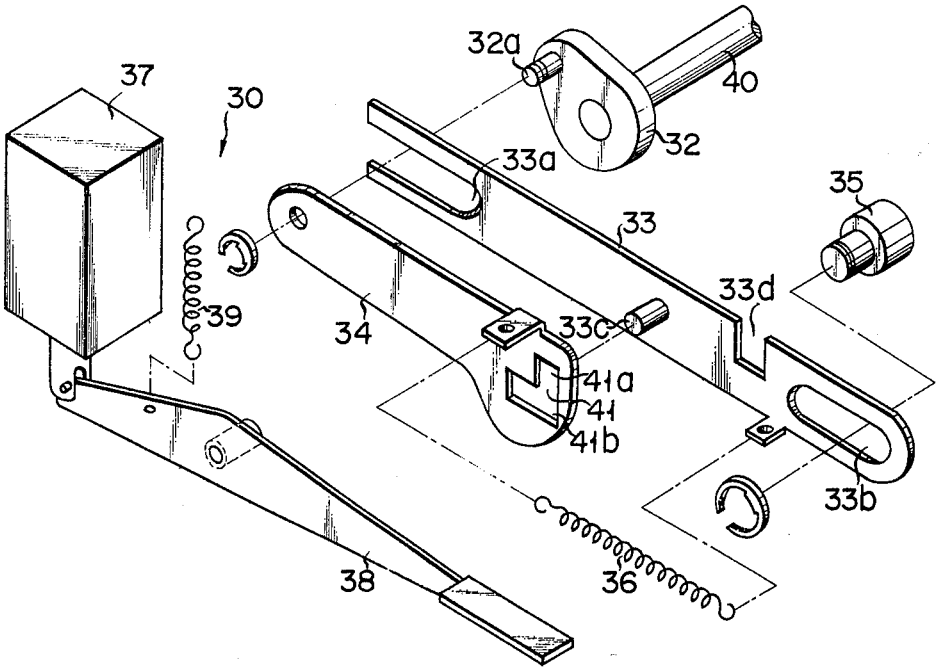
FIG. 7 is a disassembled perspective view showing a drive mechanism for the cutter mechanism.

As shown in FIGS. 1 and 7, the drive mechanism 30 comprises an eccentric cam 32, a longer first connecting rod 33, a shorter second connecting rod 34, a guide 35, a spring 36, a plunger solenoid 37, a lever 38, and a spring 39. The eccentric cam 32 is eccentrically fixed, by means of a clutch mechanism as mentioned later, to one end of a rotating shaft 40 which is coupled to the drive mechanism 10 with a motor 10*a* to be rotated thereby. An engaging pin 32 protrudes from one end of the eccentric cam 32. The engaging pin 32*a* is passed through an elongate indentation or slit 33*a* formed at one end of the first connecting rod 33 and extending along the longitudinal direction thereof, and may move along the longitudinal direction of the slit 33*a*. The projected end of the engaging pin 32*a* is rockagly coupled to one end portion of the second connecting rod 34. Formed at the other end portion of the first connecting rod 33 is a slot 33*b* extending along the longitudinal direction of the first connecting rod 33. A guide pin 35 protruding from the frame of the base section 1*a* is slidably loosely fitted in the slot 33*b*. Further, a regulating pin 33*c* protrudes from the central portion of the first connecting rod 33, and an engaging indentation 33*d* is formed in the upper edge of the rod 33 between the pin 33*c* and the slot 33*b*. The second connecting rod 34 is arranged parallel to the first connecting rod 33, and an engaging hole 41 is formed at the other end portion of the second connecting rod 33. The engaging hole 41 is L-shaped, consisting of an upper narrower portion 41*a* and a lower wider portion 41*b*. The engaging pin 33*c* of the first connecting rod 33 is loosely inserted in the engaging hole 41 so as to be able to move crosswise and vertically. The spring 36 is a tension spring both ends of which are coupled to the first and second connecting rods 33 and 34, respectively. The spring 36 urges the first connecting rod 33 to move along the second connecting rod 34 toward the engaging pin 32*a* or backward. The interlocking receiving portion 29*b* of the bell crank 29 is associated with the engaging indentation 33*d* of the first connecting rod 33 so as to be able to engage the same. The engagement or disengagement between the engaging indentation 33*d* and the interlocking receiving portion 29*b* is controlled by the rocking of the swing unit 12. Alternatively, such an engaging mechanism may be made up by forming an engaging pin on the first connecting rod 33 and an indentation in the bell crank 29 so that the pin may engage the indentation. One end of the lever 38 pivotally mounted at the middle portion on the base section 1*a* is pivotally mounted on the tip end of the plunger of the plunger solenoid 37 which is fixed to the base section 1*a*. A flat-top abutting portion is formed at the other end of the lever 38, facing the bottom face of the other end of the second connecting rod 34. The spring 39 is a tension spring both ends of which are coupled to the one end of the lever 38 and the upper portion of the base section 1*a*, respectively. The spring 39 urges the lever 38 to rock in the clockwise direction of FIG. 1.

The movable blade mechanism 18 and the drive mechanism 30 constructed in the aforementioned manner are separated from each other, and are operatively connected only through the engagement between the interlocking receiving portion 29*b* and the engaging indentation 33*d*. The engagement and disengagement between these mechanisms can be automatically achieved by only opening or closing the swing unit 12 without requiring any special manual operation.

Figure 3:
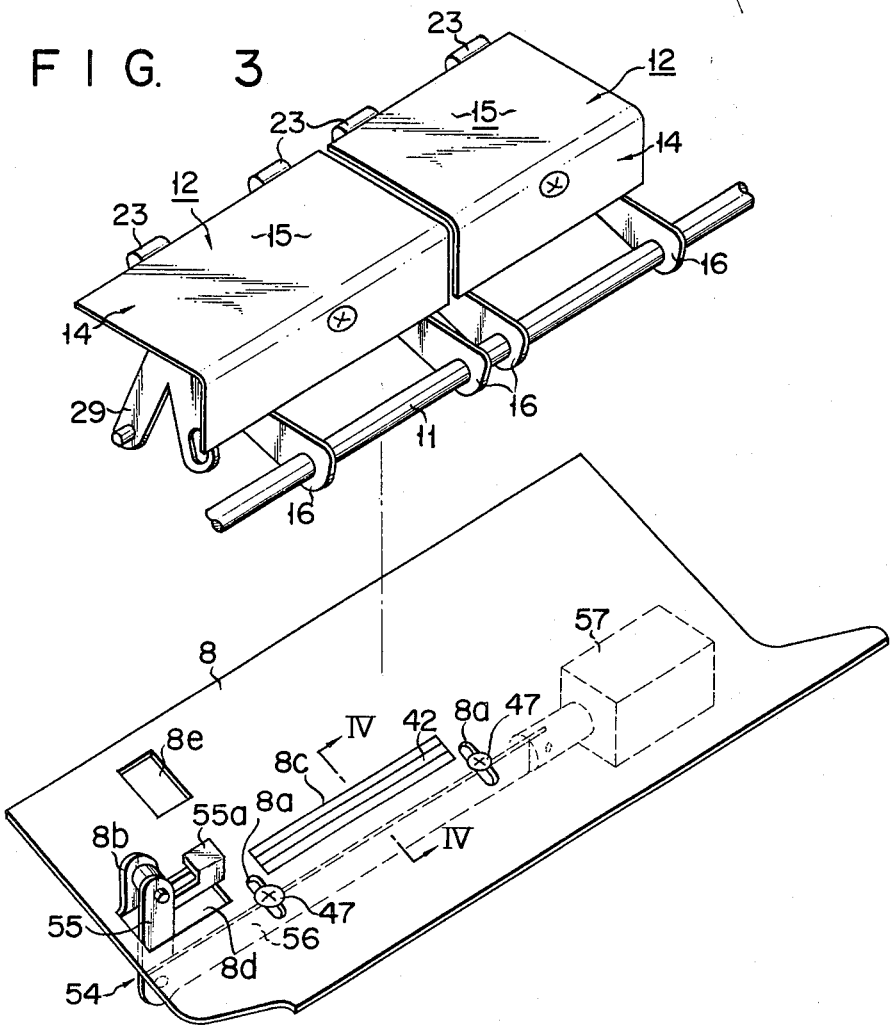
FIG. 3 is a disassembled perspective view showing the swing units and a discharge guide.
Figure 4:
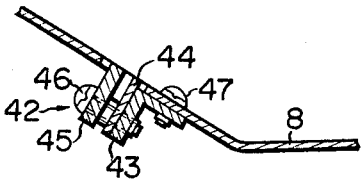
Figure 5:
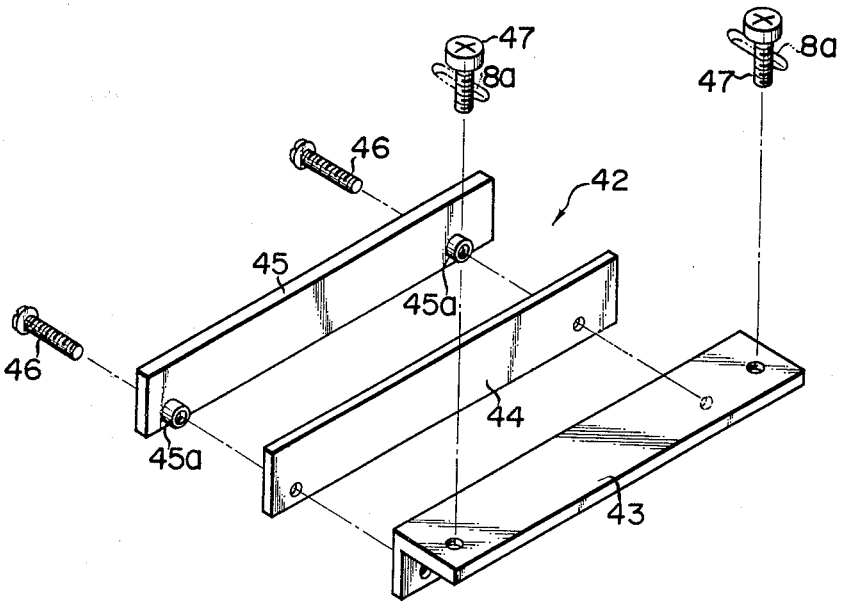

A fixed blade mechanism 24 of the cutter mechanism is formed as a single unit, and is attached to the discharge guide 8. As shown in FIGS. 3 to 5, the fixed blade mechanism 42 comprises a base 43, a fixed blade 44, and a movable blade guide plate 45. The base 43 is formed of a plate member having a horizontally extending upper portion and L-shaped in section. The fixed blade 44 is attached to the base 43 so that they are in contact with one lateral face of each other. The movable blade guide plate 45 is disposed on the other lateral face side of the fixed blade 44 with a spacer 45*a* between them. The members 43, 44 and 45 are disjoinably united by means of screws 46. A cutting action is executed when the movable blade 26 is inserted into the gap defined between the fixed blade 44 and the guide plate 45 by the spacer 45*a*. As shown in FIG. 3, the fixed blade mechanism 42 is upwardly opposed to a slit 8*c* in the discharge guide 8, and is fixed to the discharge guide 8 by means of screws 47. Screw holes of the discharge guide 8 are formed of slots 8*a* extending along the paper carrying direction. The fitting position of the fixed blade mechanism 42 can be shifted for adjustment within the range of the length of the slots 8*a* along the carrying direction of the discharge guide 8.

In the cutter mechanism of the above-mentioned construction, the blank strip A is cut once when the eccentric cam 32 makes one turn. When the eccentric cam 32 is rotated by the motor 10*a*, the first connecting rod 33 is slidden forward along the second connecting rod 34 against the urging force of the spring 36, through the engagement between the pin 32*a* and the slit 33*a*. The sliding stroke of the first connecting rod 33 depends on the width of the engaging hole 41 which engages the pin 33*c*. The forward slide of the first connecting rod 33 causes the bell crank 29 to rock in the counterclockwise direction of FIG. 6 through the engagement between the engaging indentation 33*d* and the pin 29*b*. As a result, the movable blade arm 27 is rocked clockwise against the urging force of the spring 28, through the engagement between the engaging slot 29*a* and the pin 27*b*, to move the pin 27*a* downward. The downward movement of the pin 27*a* causes the movable blade 26, which has its horizontal slot 26*a* engaged with the pin 27*a*, to move downward to cut the blank strip A in cooperation with the fixed blade 44. The action achieved thus far is caused by a first half turn of the eccentric cam 32. As the first connecting rod 33 is returned by another half turn of the eccentric cam 32, the drive mechanism 30 and the movable blade mechanism 18 are restored by the springs 36 and 27 to stand ready for the next cutting action. In such cutting operation, the lever 38 does not act on the second connecting rod 34 while the plunger solenoid 37 is unexcited. Therefore, the first connecting rod 33 is slidden over a long distance, since the engaging pin 33*c* of the first connecting rod 33 is located in the narrower portion 41*a* of the engaging hole 41 of the second connecting rod 34. Accordingly, both the rocking angle of the bell crank 29 and the downward stroke of the movable blade 26 become great enough for the so-called full-cut operation. When the plunger solenoid 37 is excited, on the other hand, the lever 38 is rocked counterclockwise against the urging force of the spring 39 to cause the second connecting rod 34 to rock counterclockwise. As a result, the engaging pin 33*c* comes to be located in the wider portion 41*b* of the engaging hole 41, allowing the first connecting rod 33 to slide over a short distance. Then, the movable blade 26 is lowered at a short stroke to perform the so-called stub-cut operation.

Figure 8:
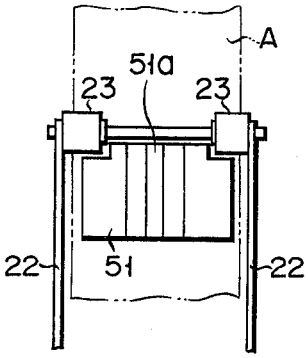
FIG. 8 is a plan view showing a stamp and pinch rollers.

As shown in FIG. 6, the driven mechanism 19 of the stamp mechanism comprises a stamp base 48, a stamp lever 49, a spring 50, and a stamp 51. The stamp base 48 faces the auxiliary frame 14*c*, and is provided with an engaging pin 48*a* protruding from the center of one lateral face thereof, and vertically extending slots 48*c* at both end portions. The stamp lever 49 is arched, and is pivotally mounted on a pin 52 protruding from the inner surface of the intermediate plate portion $14a_1$ of the unit frame 14. A slot 49*a* is formed at one end portion of the lever 49, extending along the longitudinal direction thereof. The engaging pin 48*a* of the stamp base 48 is slidably fitted in the slot 49*a*, and thus the stamp base 48 is supported on the lever 49. The other end portion 49*b* of the stamp lever 49 extends through an opening 53 in the side wall $14a_2$ of the unit frame 14 to project outside the unit frame 14. The other end portion 49*b* functions as an interlocking receiving portion as mentioned later. The spring 50 is a tension spring which is stretched between the lever 49 and the auxiliary frame 14*c* to urge the lever 49 to rock counterclockwise. The stamp base 48 has a support portion 48*b* which is formed by bending the upper middle portion of the stamp base 48 at an angle of 90° thereto in the opposite direction to the auxiliary frame 14*c*. The support portion 48*b* is inserted in a guide hole in a flat-top ridge portion 51*b* protruding from the substantially central portion of the stamp 51, and thus the stamp 51 is supported on the stamp base 48. The stamp 51 is so disposed that the ridge portion 51*b* may be located halfway between the pair of pinch rollers 23, as shown in FIG. 8. Such an arrangement is helpful in increasing the printing area of the stamp 51 and in facilitating the working of the rollers 23, as well as in preventing stains on the rollers 23 from being transferred to the printing paper or blank A (especially when a printed region of the paper passes by the rollers 23 after stamp printing). The stamp base 48, the auxiliary frame 14*c*, and the movable blade 26 are attached to the unit frame 14 with the screws 31 passed through the slots 48*c* in the stamp base 48, holes in the auxiliary frame 14*c*, and the slots 26*b* in the movable blade 26, and with the tip ends of the screws 31 screwed into holes in the intermediate plate portion $14a_1$ of the unit frame 14.

The driven mechanism 19 of the above-mentioned construction is operatively connected with a drive mechanism 54 of the stamp mechanism when the swing unit 12 is in the closed position. As shown in FIG. 3, the drive mechanism 54 is attached to the discharge guide 8, and is composed of a crank 55, a connecting rod 56, and a plunger solenoid 57. The discharge guide 8 has a rectangular opening 8*d* and a support strip 8*b* raised up from the edge of the opening 8*d*. The upper portion of the crank 55 is L-shaped and extends over the upper surface of the guide 8 to cross the same. The crank 55 is pivotally mounted at the middle portion thereof on the support strip 8*b*, having its lower portion extending through the opening 8*d* to be located below the guide 8. The extended end of the crank 55 is pivotally mounted on the connecting rod 56 which extends under and across the guide 8. The other end of the connecting rod 56 is coupled to the plunger of the plunger solenoid 57 which is fixed to the lower surface of the guide 8. As mentioned before, the upper portion of the crank 55 extends across the guide 8, thus forming an interlocking portion 55*a* to abut on or be located near the interlocking receiving portion 49*b*.

The driven mechanism 19 and the drive mechanism 54, which are independently constructed in the aforesaid manner, are operatively connected or disconnected automatically through the engagement or disengagement between the interlocking receiving portion 49*b* and the interlocking portion 55*a* by only rocking the swing unit 13, without requiring any special manual operation for such connecting or disconnection.

As described before, the stamp mechanism is composed of the driven mechanism 19 and the drive mechanism 54, and performs stamp printing on the printing paper A. When the plunger solenoid 57 is excited, the crank 55 is rocked in the counterclockwise direction of FIG. 3 by the action of the connecting rod 56, so that the interlocking portion 55*a* presses the interlocking receiving portion 49*b* (FIG. 9) from under. Thus, the stamp lever 49 is rocked in the clockwise direction of FIG. 6 against the urging force of the spring 50 to push down the stamp base 48 and the stamp 51 through the engagement between the slot 49*a* and the pin 48*a*, thereby causing the stamp 51 to perform stamp printing on the printing paper A. When the plunger solenoid 57 is demagnetized, the driven mechanism 19 and the drive mechanism 54 are returned by the urging force of the spring 50 to stand ready for the next operation.

As described before, the swing unit for the receipt blank strip comprises the movable blade mechanism 18 and the driven mechanism 19 operatively connected with their respective drive mechanisms, as well as the pinch roller mechanism 17. As for the swing unit for the journal blank strip, however, it is provided with neither the movable blade mechanism nor the driven mechanism, although it includes the pinch roller mechanism 17.

Figure 2:
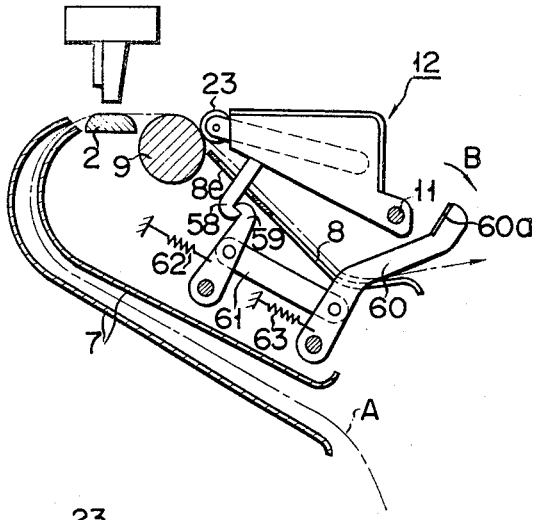
FIG. 2 is a sectional view showing a holding mechanism for a swing unit.

Referring now to FIG. 2, there will be described a unit holding mechanism for holding the swing unit 12 in the closed position. This mechanism comprises a click 58, a click link 59, an operating link 60, a coupling link 61, and springs 62 and 63. The click 58 protrudes downward from the unit frame 14 and extends through an opening 8*e* in the discharge guide 8 up to the region under the guide 8. The click 58 may engage the upper end of the click link 59 whose lower end is pivotally mounted on the base section. One end of the coupling link 61 is pivotally mounted on the click link 59, while the other end is pivotally mounted on the operating link 60 whose lower end is pivotally mounting on the base section. Stretched between the click link 59 and the base section is the tension spring 62 which urges the click link 59 to rock counterclockwise or in the engaging direction. Stretched between the operating link 60 and the base section, moreover, is the tension spring 63 which urges the operating link 60 to rock counterclockwise. The upper end of the operating link 60 extends from the front of the base section, and is provided with an operating portion 60*a* to be pressed by fingers.

In the above-mentioned construction, when the swing unit 12 is in the closed position (represented by solid line in FIG. 1), the click 58 penetrates the opening 8*e* to engage the upper end portion of the click link 59, and is held as it is. In this state, if the operating portion 60*a* is pressed by fingers in the direction indicated by arrow B in FIG. 2, it rocks in the same direction (clockwise direction) against the urging force of the springs 62 and 63. As a result, the click link 59 is rocked clockwise by the action of the coupling link 61 to be disengaged from the click 58. Thus, the swing unit 12 can be rocked to the open position (represented by imaginary line in FIG. 1) by manual operation.

As shown in FIG. 1, the apparatus housing 1 is provided with a return mechanism 64 for forwardly carrying a slip blank in the slip blank guide 6 and a feed mechanism 65 for backwardly carrying the slip blank in the slip blank guide 6. The feed mechanism 65 comprises a drive roller 67 rotatably disposed on the side of the support section 1*b* and a pinch roller 68 on the side of the base section 1*a*. The drive roller 67 is connected through a clutch mechanism as mentioned later to the drive mechanism 10 so as to be rotated thereby. The pinch roller 68 is rotatably supported on the platen 2 by means of a support member 69. A unit composed of these members 68, 2 and 69 is attached to the base section 1*a* so as to be capable of vertical movement, and can be shifted vertically by an elevator 70 formed of a plunger solenoid. Thus, the pinch roller 68 can be attached to and detached from the drive roller 67. The return mechanism 64 comprises a drive roller 71, a pinch roller 72 capable of being attached to and detached from the drive roller 71, a roller support rod 73 to operate the pinch roller 72, and a plunger solenoid 74. The drive roller 71 is rotatably disposed on the side of the base section 1*a*, and is rotated by the drive roller 67 through an idle roller 75 which is interposed between the drive rollers 71 and 67. The first drive roller 67 is rotated clockwise as indicated by an arrow to feed a slip held between itself and the pinch roller 68. While the second drive roller 71 is also rotated clockwise, it returns the slip held between itself and the pinch roller 72 since it is on the side of the base section 1*a*. The pinch roller 72 is rotatably supported on one end of the substantially horizontal roller support rod 73 which is pivotally mounted at the middle portion thereof on the support section 1*b*. The other end of the support rod 73 is pivotally mounted on the tip end of the vertically movable plunger of the plunger solenoid 74. Thus, when the plunger solenoid 74 is excited, the pinch roller 72 is transferred to the side of the drive roller 71 by the action of the support rod 73.

Referring now to FIGS. 9 and 10, there will be described a clutch mechanism 80 which can selectively transmit the driving force of the drive mechanism 10 including the motor 10*a* to the feed rollers 9, the cutter drive mechanism 30, and the slip blank feed mechanism 65.

The mechanism 80 includes a common shaft 81 which is rotated by a rotatory force transmitted from the motor 10*a* through a gear train 10*b*. Four one-way clutches 82*a*, 82*b*, 82*c* and 82*d* are arranged on the shaft 81 at predetermined axial intervals. Each clutch is composed of a rotary disk 84 and a gear 85 facing each other with a given space between them, and a plurality of pawls arranged at regular intervals along the circumferential direction of the shaft 81 between the disk 84 and the gear 85. Engaging members 86*a*, 86*b*, 86*c* and 86*d* are so disposed as to correspond to the clutches 82*a* to 82*d*, and solenoids 87*a*, 87*b*, 87*c* and 87*d* are so arranged as to drive the engaging members to be engaged with or disengaged from the pawls of their corresponding clutches. The proximal ends of the engaging members 86*a* to 86*d* are pivotally mounted on a common shaft 88 so that the distal ends may rotate independently within vertical planes. The respective proximal ends of the engaging members are coupled with one ends of tension springs (only a spring 89*a* for the engaging member 86*a* is shown in FIG. 9; those for the other members 86*b* to 86*d* are omitted). The other ends of the tension springs are coupled to the base section, thus urging their corresponding engaging members to engage the pawls of their corresponding clutches. The clutches are so constructed that the rotatory force of the shaft 81 will not be transmitted to the gears of the clutches, that is, the shaft 81 will rotate independently, when the engaging members are engaged with the pawls, and that the rotation of the shaft 81 will cause the gears to rotate when the engaging members are not engaged with the pawls. The engaging members may be disengaged from the pawls when they are rocked against the urging force of their corresponding tension springs by exciting their corresponding solenoids. All the engaging members 86*a* to 86*d* and the solenoids 87*a* to 87*d* are supported on a common support plate 90 with an L-shaped section.

The gear 85 of the first clutch 82*a* is meshed through an intermediate gear 91 with a gear 92 which is coaxial with the journal paper feed roller 9, and selectively transmits the rotatory force from the motor 10*a* to the roller 9. Likewise, the second clutch 82*b* is operatively connected with the receipt paper feed roller 9 by means of gears 93 and 94. The gear 85 of the third clutch 82*c* is meshed with a gear 95 which is coaxially attached to the shaft 40 to rotate the eccentric cam 32 of the cutter drive mechanism 30, and selectively transmits the rotatory force of the motor 10*a* to the shaft 40. The gear 85 of the fourth clutch 82*d* is in mesh with one gear 97 out of two gears 97 and 98 which are coaxially attached to a rotatable intermediate shaft 96. The other gear 98 is in mesh with another gear 99 which is coaxial with the drive rollers 67 of the feed mechanism. Thus, the fourth clutch 82*d* selectively transmits the rotatory force to the roller 67 with the aid of the gears 97, 98 and 99. In FIG. 9, numeral 100 designates a rotation detecting mechanism which comprises a detecting disk 101 mounted on the rotating shaft of the motor 10*a* so as to rotate therewith and having teeth on its peripheral surface, and a detector 102 disposed near the disk 101 to detect the rotation angle and/or rotational frequency of the disk 101. The detector may be of a type to detect optically the number of teeth of the disk 101 passing by the detector. In this embodiment, however, the detector 102 is formed of a proximity switch which abuts only on the top portions of the teeth to be closed. The excitation timing of the solenoids 87*a* to 87*d* is controlled by output pulse signals from the detector 102 which correspond to the rotation angle and/or rotational frequency of the disk 101. Such control will not be affected by variations of the rotational frequency of the motor 10*a* which may be caused by voltage changes. Thus, the actions of the clutches can respond to the rotation of the motor with improved accuracy, as compared with the case of time-based control of excitation.

There will now be described the way of setting the blank strip A in the cash register of the above-mentioned construction.

First, the forward end of the blank strip A is inserted into the feed guide 7 through its lower end opening, and led to the upper end opening. Thereafter, the operating link 60 of the unit holding mechanism is pressed to rock the swing unit 12 to the open position (represented by chain line in FIG. 1). Thus, the front of the discharge guide 8 is opened. In this state, the blank strip A is drawn out onto the front of the discharge guide 8 via the platen 2, and then the swing unit 12 is rocked to the original position or closed position to close the discharge guide 8. As a result, the closed position of the swing unit 12 is maintained automatically by the unit holding mechanism, and the rollers 23 press the blank strip A against their corresponding feed rollers 9. Also, the movable blade mechanism 18 and the driven mechanism 19 are operatively connected with their corresponding drive mechanisms 30 and 54. Thus, the setting of the blank strip A may be completed with ease despite the use of the substantially inverted U-shaped feed path for the blank strip A. The journal blank strip may be easily set in the same manner.

After the blank strip is set in place, it is fed each time the feed roller 9 is rotated by the drive mechanism 10 in accordance with a feed signal. Since the positions of the rotatable contact between the feed roller 9 and the rollers 23 of the pinch roller mechanism 17 are located ahead of the platen 2, the blank strip is pulled forward as it passes by the platen 2. Accordingly, even if feed resistance is produced on the side of the discharge guide 8, the blank strip on the platen 2 will never be lifted off the platen 2. It is therefore possible to prevent deterioration of print quality and production of high printing noise, as well as jam which may be caused if the blank strip is lifted off the platen 2 and caught by the printing head 3. Thus, high-quality printing and accurate paper feeding may be achieved. After prescribed printing (including stamp printing) is performed, the receipt blank strip is cut by a cutter mechanism.

Now there will be described the way the slip is issued.

A slip blank is put on the guide walls 15 of the swing units 12 in the closed position, and is then pushed along the walls 15 into the printing section. Thereafter, the elevator 70 is operated to move the pinch roller 68 upward. In consequence, the forward end portion of the slip blank is held between the drive roller 67 and the pinch roller 68. Since the drive roller 67 is rotated in the clockwise direction of FIG. 1 by shifting the clutch 82*d* of the clutch mechanism each time the printing action of the printing head 3 for one line is completed, so the slip blank is fed through the slip blank guide 6 toward the back side of the apparatus housing 1. When printing of a prescribed number of lines is completed after repeating such printing and feeding actions, the platen 2 and the pinch roller 68 are lowered, and the plunger solenoid 74 is excited to press the pinch roller 72 against the drive roller 71 so that the slip blank is held between them. In this state, the rotatory force from the drive roller 67 is transmitted through the idle roller 75 to the drive roller 71, so that the roller 71 is rotated in the clockwise direction of FIG. 1. Then, the printed slip paper is fed through the slip blank guide 6 toward the platen 2 by continuous operation of the return mechanism 64 to be returned onto the guide walls 15 via the printing section. If the slip blank is comparatively short, the printed slip may be easily taken out to be issued in the aforesaid manner. If the slip blank is comparatively long, then the printed portion of the slip blank will backwardly pass through the rear end opening 6*a* of the slip blank guide 6 without clogging the guide 6.

Guided by the guide walls 15 of the swing units 12, the slip blank can be easily inserted into the printing section at the slip issue. The terminal portion of the feed path for the blank strip is defined by the discharge guide 8 and the swing units 12, and is located below the guide walls 15. Further, one of the mechanisms including the movable blade mechanism 18 is not exposed outside the guide walls 15. Accordingly, the blank strip will never interfere with the insertion of the slip blank.

Since part of the unit frame 14 of the swing unit 12 is utilized as the guide for the insertion of the slip blank into the printing section, there is no need of any special guide means therefor. Thus, the apparatus requires no increase of components in number, and may be simplified in construction. Moreover, the guide walls 15 do not protrude substantially from the apparatus housing 1, so that the apparatus can enjoy compact design and fine external appearance.

Since each swing unit 12 can be rocked to the position represented by imaginary line in FIG. 1, it is very easy to carry out the inspection, adjustment, repair, etc., of the pinch roller mechanism 17, the movable blade mechanism 18, and the driven mechanism 19 housed in the swing unit 12, as well as of the discharge guide 8. Thus, the maintenance work can be facilitated, requiring no thoroughgoing dismantling of the apparatus housing 1.

What we claim is:

1. An apparatus with a printer for a printing paper strip, comprising:

an apparatus housing;

a platen provided to the apparatus housing;

a paper feed guide having an outlet on one side of the platen, through which the printing paper strip is guided to the platen;

a paper discharge guide having an inlet on the other side of the platen, through which the printing paper strip is guided from the platen;

a unit frame attached to the apparatus housing to be able to rock between an open position where the paper discharge guide is exposed and a closed position where the paper discharge guide is covered and the printing paper strip is allowed to be guided;

a drive roller provided to the apparatus housing located on the other side of the platen;

a pinch roller mechanism provided to the unit frame and having a pinch roller which goes away from the drive roller when the unit frame is located in the open position, and approaches the drive roller when the unit frame is located in the closed position, so that the printing paper strip is held between the pinch roller and the drive roller when the pinch roller is brought close to the drive roller; and a rotation drive mechanism for rotating the drive roller to carry the printing paper strip from the paper feed guide to the paper discharge guide via the platen.

2. The apparatus with a printer according to claim 1, further comprising a stamp mechanism including a stamp provided to the unit frame to be able to move reciprocately and a drive gear in the apparatus housing for reciprocately moving the stamp.

3. The apparatus with a printer according to claim 2, wherein said stamp and said drive mechanism are operatively connected when the unit frame is in the closed position, and are disconnected when the unit frame is rocked to the open position.

4. The apparatus with a printer according to claim 1, further comprising a cutter mechanism including a fixed blade mechanism in the apparatus housing, a movable blade mechanism provided with a movable blade provided to the unit frame to be able to move reciprocately, and a drive mechanism provided to the apparatus housing for moving the movable blade in one direction to cut the printing paper strip in cooperation with the fixed blade mechanism.

5. The apparatus with a printer according to claim 4, wherein said movable blade and said drive mechanism are operatively connected when the unit frame is in the closed position, and are disconnected when the unit frame is rocked to the open position.

6. The apparatus with a printer according to claim 5, wherein said movable blade drive mechanism includes means for adjusting the stroke of the movable blade.

7. The apparatus with a printer according to claim 1, further comprising a slip blank guide provided to the apparatus housing located on said one side of the platen, whereby a slip blank is guided to and from the platen, a paper feed mechanism provided to the apparatus housing for carrying the slip blank in the slip blank guide away from the platen, a paper return mechanism provided to the apparatus housing for carrying the slip blank in the slip blank guide toward the platen, and means for selectively operating the paper feed mechanism and the paper return mechanism.

8. The apparatus with a printer according to claim 7, wherein said unit frame has a guide wall to be located substantially flush with said slip blank guide when the unit frame is in the closed position, the platen being located between the guide wall and the slip blank guide.

9. The apparatus with a printer according to claim 8, further comprising a clutch mechanism for selectively operatively connecting said rotation drive mechanism with the drive roller, the paper return mechanism, and the paper feed mechanism.

* * * * *